US006832960B2

(12) United States Patent
Thöny

(10) Patent No.: US 6,832,960 B2
(45) Date of Patent: Dec. 21, 2004

(54) GOLF SWING AND HIP ROTATION CONNECTOR

(75) Inventor: Franz Thöny, Eachen (LI)

(73) Assignee: VIB Line Establishment, Schaan (LI)

( * ) Notice: Subject to any disclaimer, the term of this patent is extended or adjusted under 35 U.S.C. 154(b) by 0 days.

(21) Appl. No.: 10/668,420

(22) Filed: Sep. 23, 2003

(65) Prior Publication Data

US 2004/0063513 A1 Apr. 1, 2004

(30) Foreign Application Priority Data

Sep. 27, 2002 (CH) ..... 1625/02

(51) Int. Cl.[7] ..... A63B 69/36
(52) U.S. Cl. ..... 473/277; 473/207
(58) Field of Search ..... 473/212, 215, 473/266, 276, 277, 422

(56) References Cited

U.S. PATENT DOCUMENTS 475,432 A * 5/1892 Blades ..... 473/415
1,618,273 A * 2/1927 Davidson ..... 482/124
2,980,426 A * 4/1961 Johnson ..... 473/63
3,101,196 A * 8/1963 Ferrara ..... 473/63
3,970,316 A 7/1976 Westmoreland, Jr.
4,691,924 A 9/1987 Strong
4,892,317 A * 1/1990 Corder, Jr. ..... 473/212
5,188,365 A * 2/1993 Picard ..... 473/213
5,203,754 A * 4/1993 Maclean ..... 482/124
5,518,480 A * 5/1996 Frappier ..... 482/124
5,665,015 A * 9/1997 Clark, III ..... 473/409
6,126,554 A * 10/2000 Poscente ..... 473/212
6,129,638 A * 10/2000 Davis ..... 473/215

* cited by examiner

*Primary Examiner*—Nini F. Legesse
(74) *Attorney, Agent, or Firm*—John K. McCulloch

(57) ABSTRACT

A chest belt for encircling the back and chest of a trainee at a level above the waist, an arm strap for accommodating the upper arm portion of the trainee's leading arm, a shoulder strap for overlying the shoulder of the leading arm, a thigh strap forming a loop for encircling that thigh of the trainee opposite the leading arm, and connecting straps coupling the thigh straps to the chest strap and extending diagonally across the front and back of the trainee. The construction is such that the trainee's shoulders and hips partake of coordinated movements during the execution of a golf swing.

19 Claims, 6 Drawing Sheets

GOLF SWING AND HIP ROTATION CONNECTOR

The invention relates to a new golf swing and hip rotation coordinator as well as its use as a training device for learning to play golf, especially for learning a good golf swing.

BACKGROUND OF THE INVENTION

A large number of auxiliary exercise means are known in the field of learning or improving one's golf swing while playing golf. The objective of all these means is to perform a good golf swing. This golf swing on the other hand is closely related to the leading arm, striking arm and hips of the golf player's body.

U.S. Pat. No. 4,691,924 describes a golf training device which consists of a first band surrounding the chest and a second band surrounding the golfer's leading arm.

A similar golf training device is described in U.S. Pat. No. 3,970,316.

Although these known golf training devices according to U.S. Pat. Nos. 4,691,924 and 3,970,316 offer some progress in training the golf swing, they are still not optimal especially concerning an effective golf swing and hitting the golf ball.

It is the object of the present invention to develop a training device for learning to play golf which better controls the sequence of movement of the body, and the arms and hips in particular, while playing golf and allows in particular a more effective golf swing and better precision in hitting the golf ball.

This object is achieved in accordance with the invention in such a way that a new golf swing and hip rotation coordinator was developed which advantageously consists of a combination of mutually connected shoulder and chest belt via an intermediate band with a loop as a hip and leg band.

SUMMARY OF THE INVENTION

Said new golf swing and hip rotation coordinator comprises the following:

a) a circumferentially adjustable chest belt which is attached over the chest of a golf player at a level above that of the waist and comprises a length-adjustable double belt strap which in combination with the chest belt rigidly encircles the upper portion of the leading arm of the golf player restrains independent movement thereof and the chest belt further comprising a length-adjustable shoulder strap which is fixed to the chest belt and overlies the shoulder of the leading arm of the golf player. To the chest belt is attached a an angle each of between 45° and 75° from the chest belt and on whose ends there is attached one closure apparatus each, with the end of the shoulder strap and the joining place of the connecting strap with the closure apparatus 8 being situated at the trainee's back when worn and the joining place of the connecting strap 6 with the closure apparatus being attached directly adjacent to the arm strap and the other end of the shoulder strap with the closure apparatus 8 being connected via b) an intermediate connecting strap section with c) one portion of a strap of the thigh loop and the closure apparatus 7 directly connected with one section of the strap of the thigh loop, with the portion of the strap representing a length-adjustable strap and the strap a length adjustable strap and the two straps and extending diagonally across the chest and back at an angle of 75° to 110°, preferably 90°, with respect to each other.

THE DRAWINGS

Figure 1:
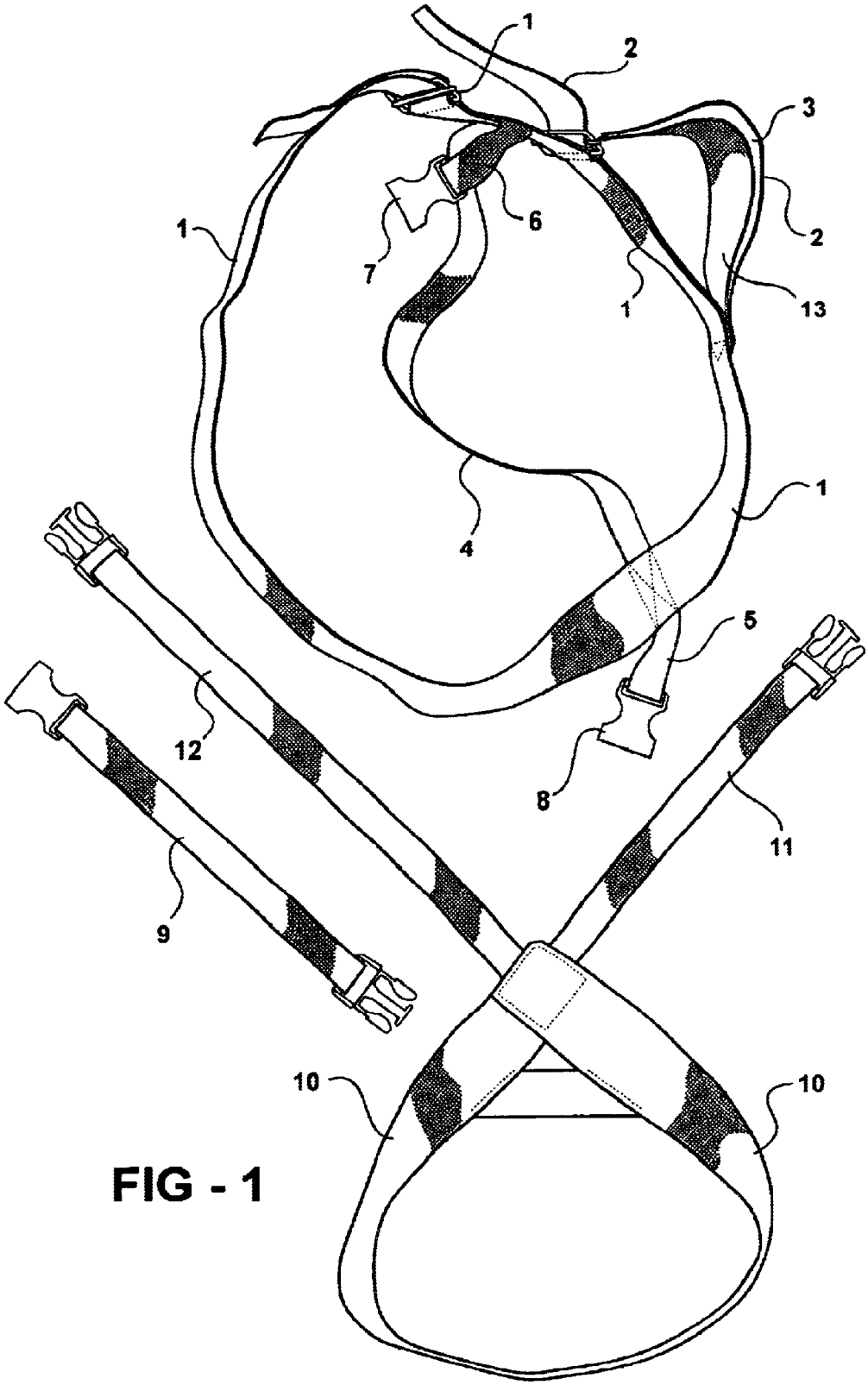
FIG. 1 shows the entire combination of parts of the training apparatus.
Figure 2:
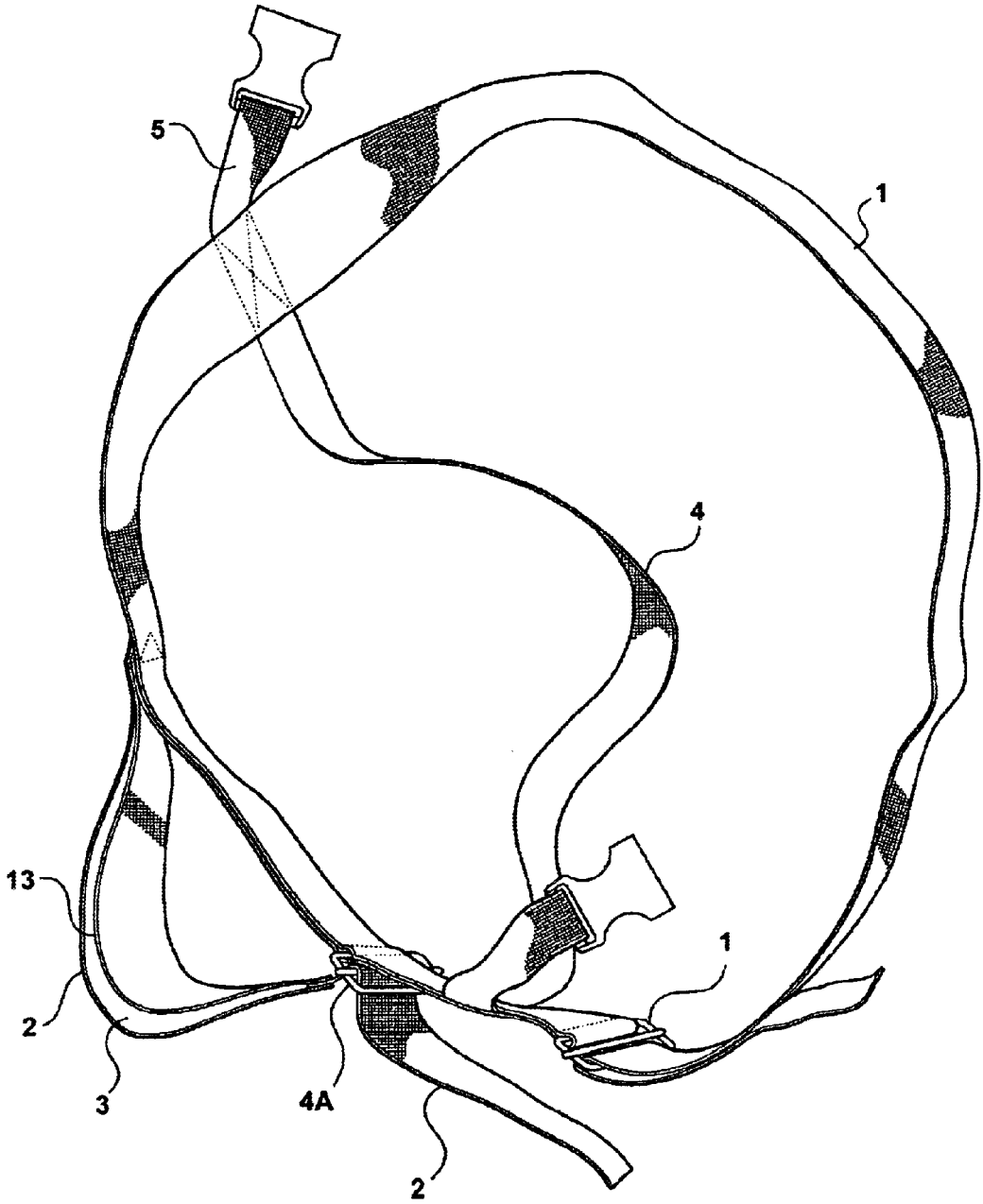
FIG. 2 shows the chest belt including the arm strap and the shoulder strap.
Figure 3:
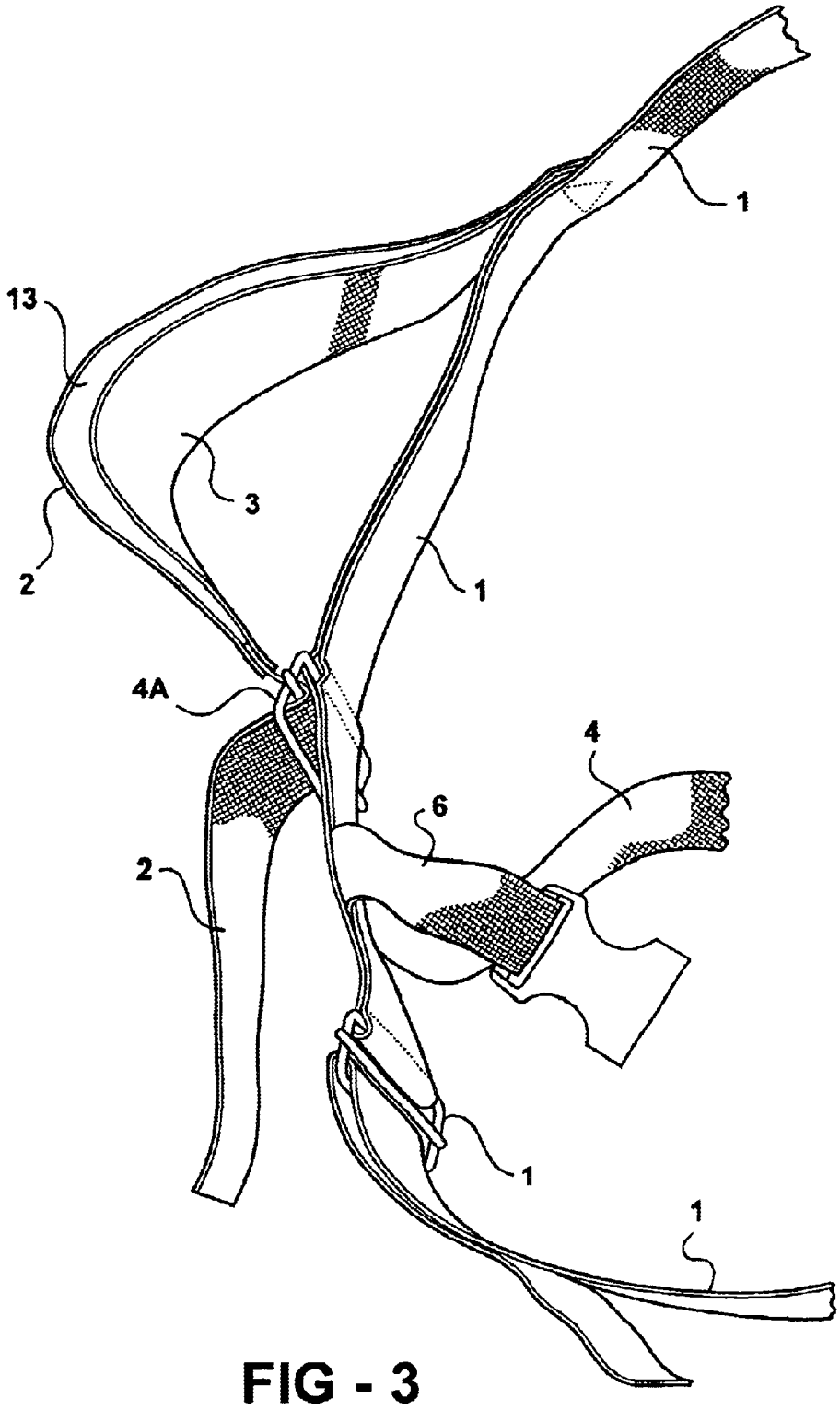
FIG. 3 shows a detailed view of the arm strap.
Figure 4:
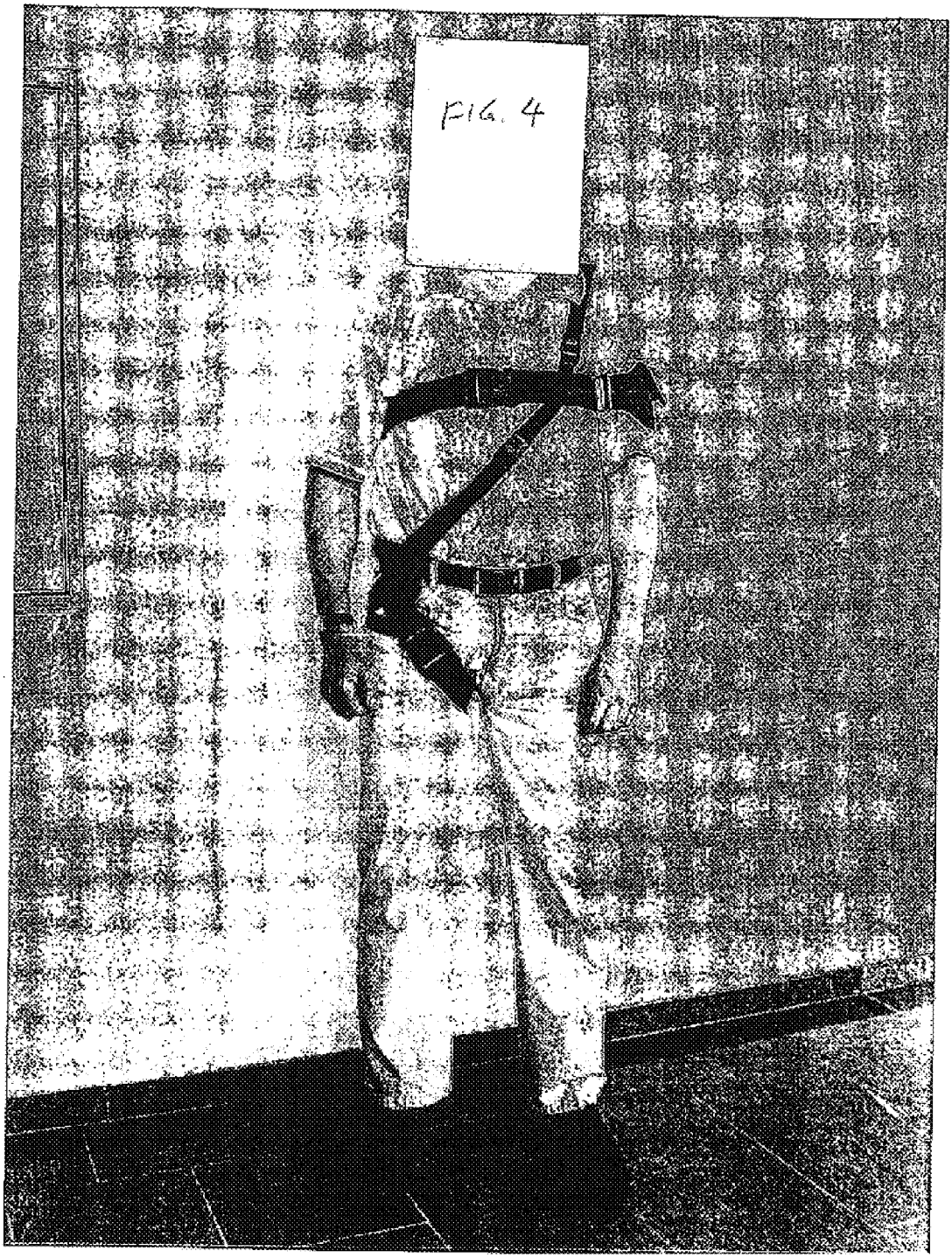
FIG. 4 is a front view showing the training apparatus as it appears when worn by a trainee.
Figure 5:
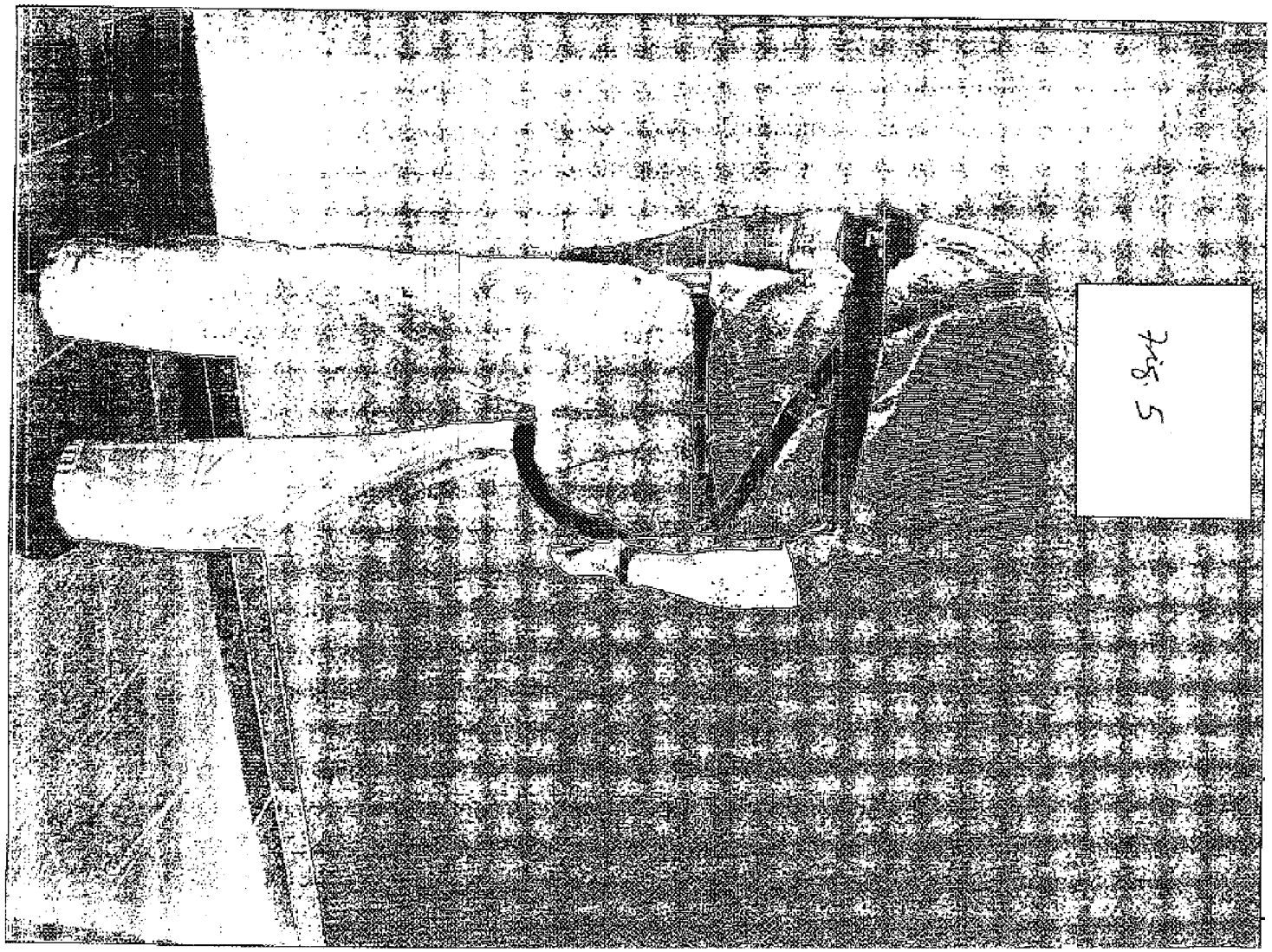
FIG. 5 is a rear view showing the apparatus when worn by the trainee.
Figure 6:
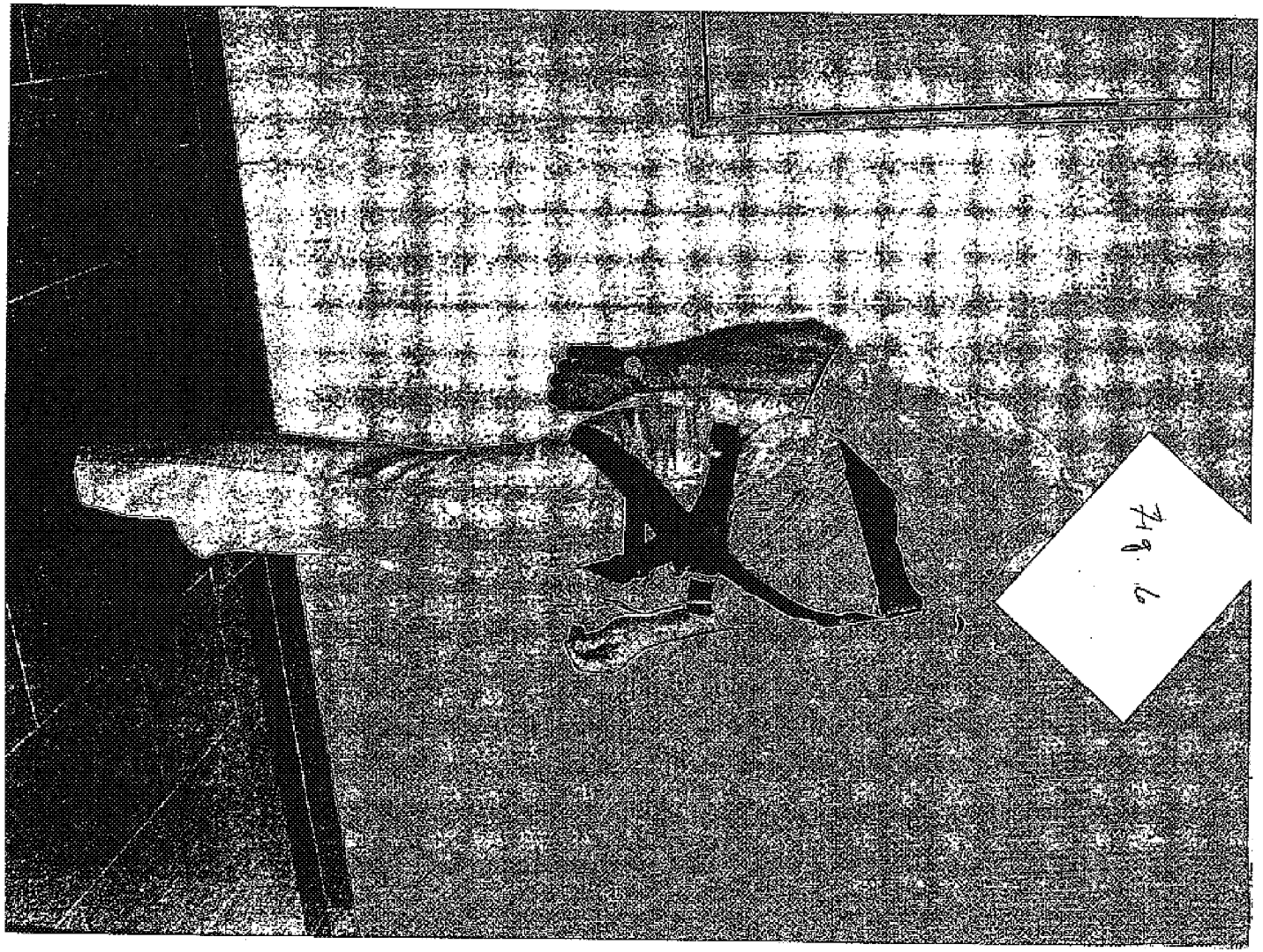
FIG. 6 is a side view of the apparatus when worn.
Figure 1:
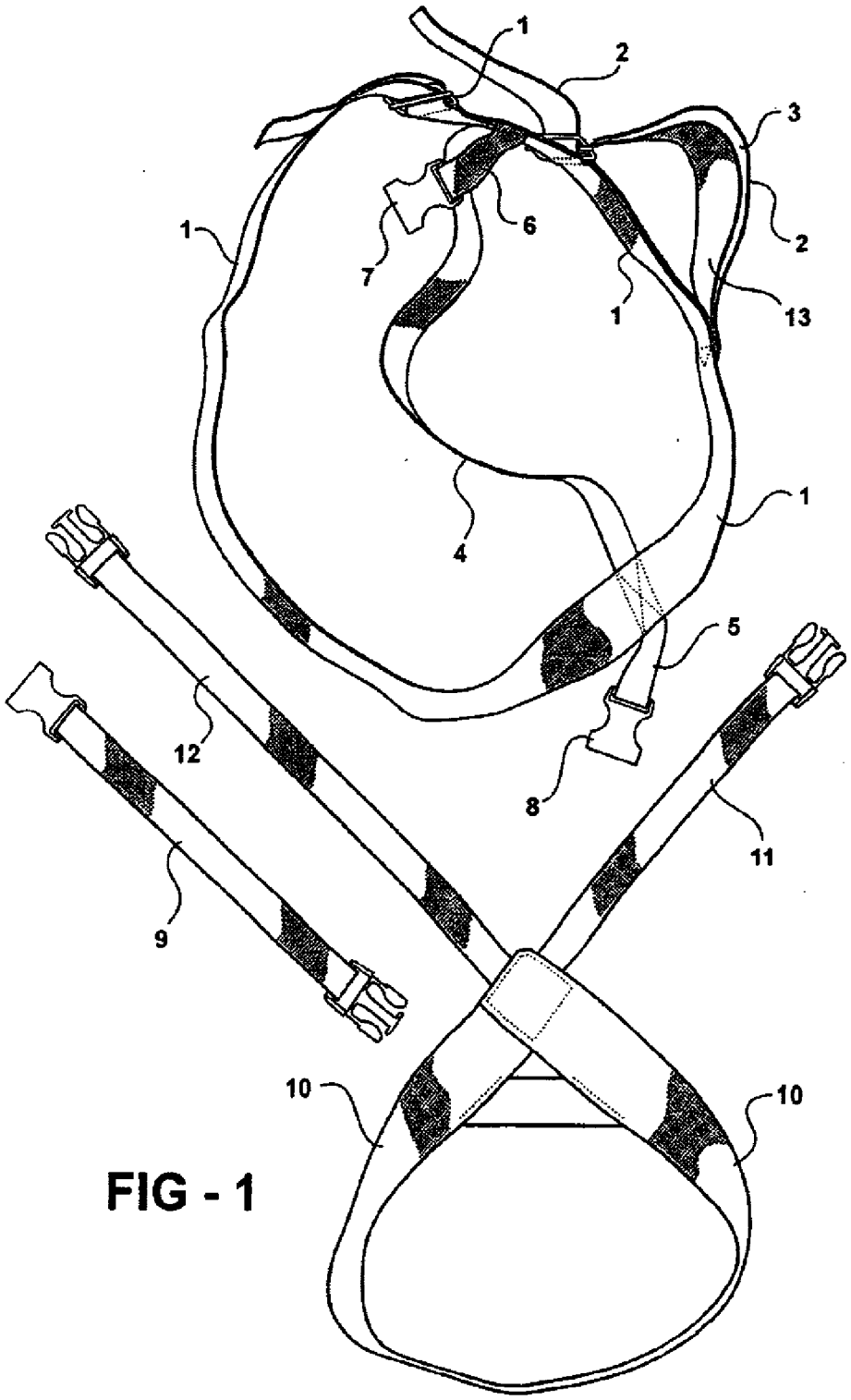
Figure 2:
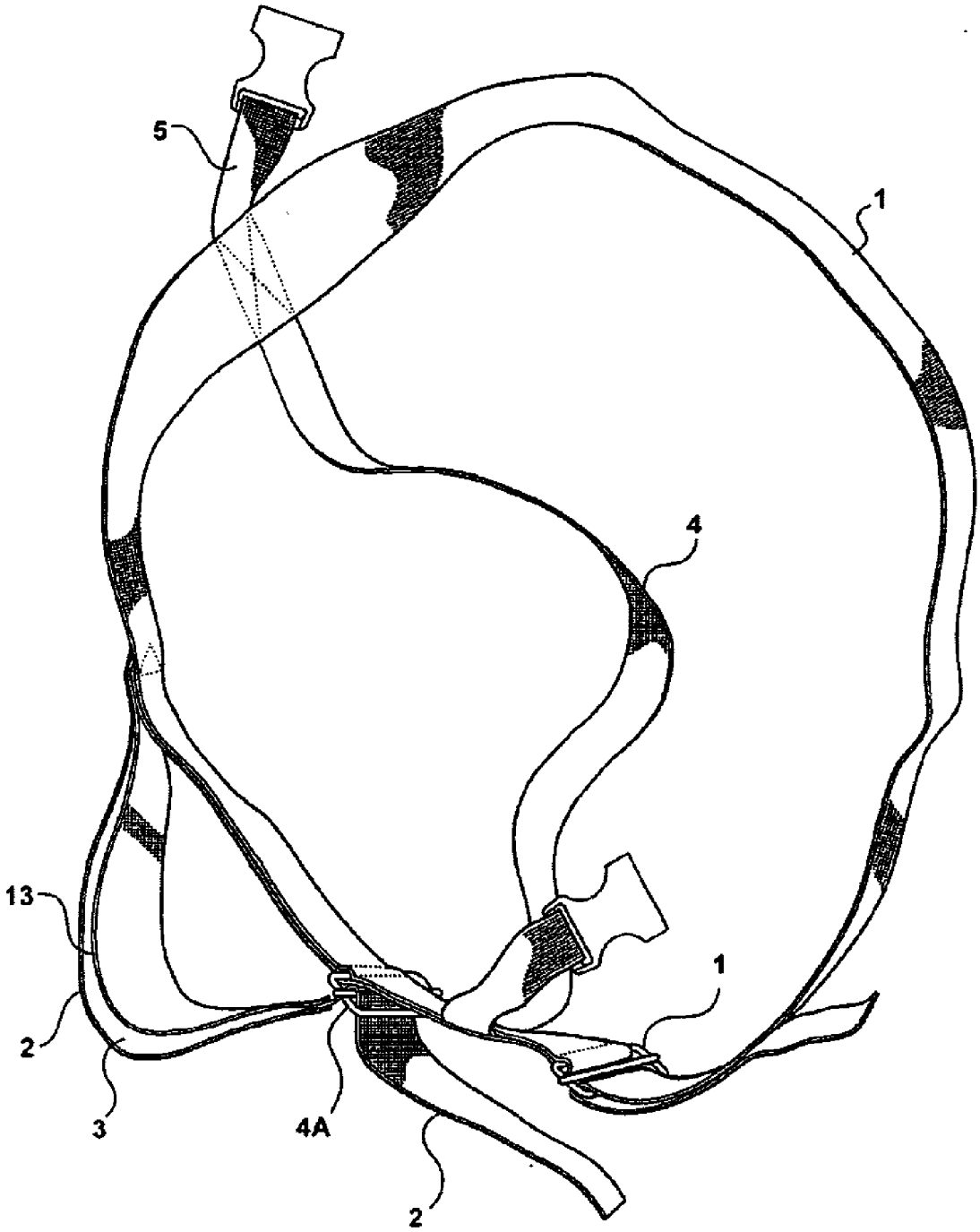
Figure 3:
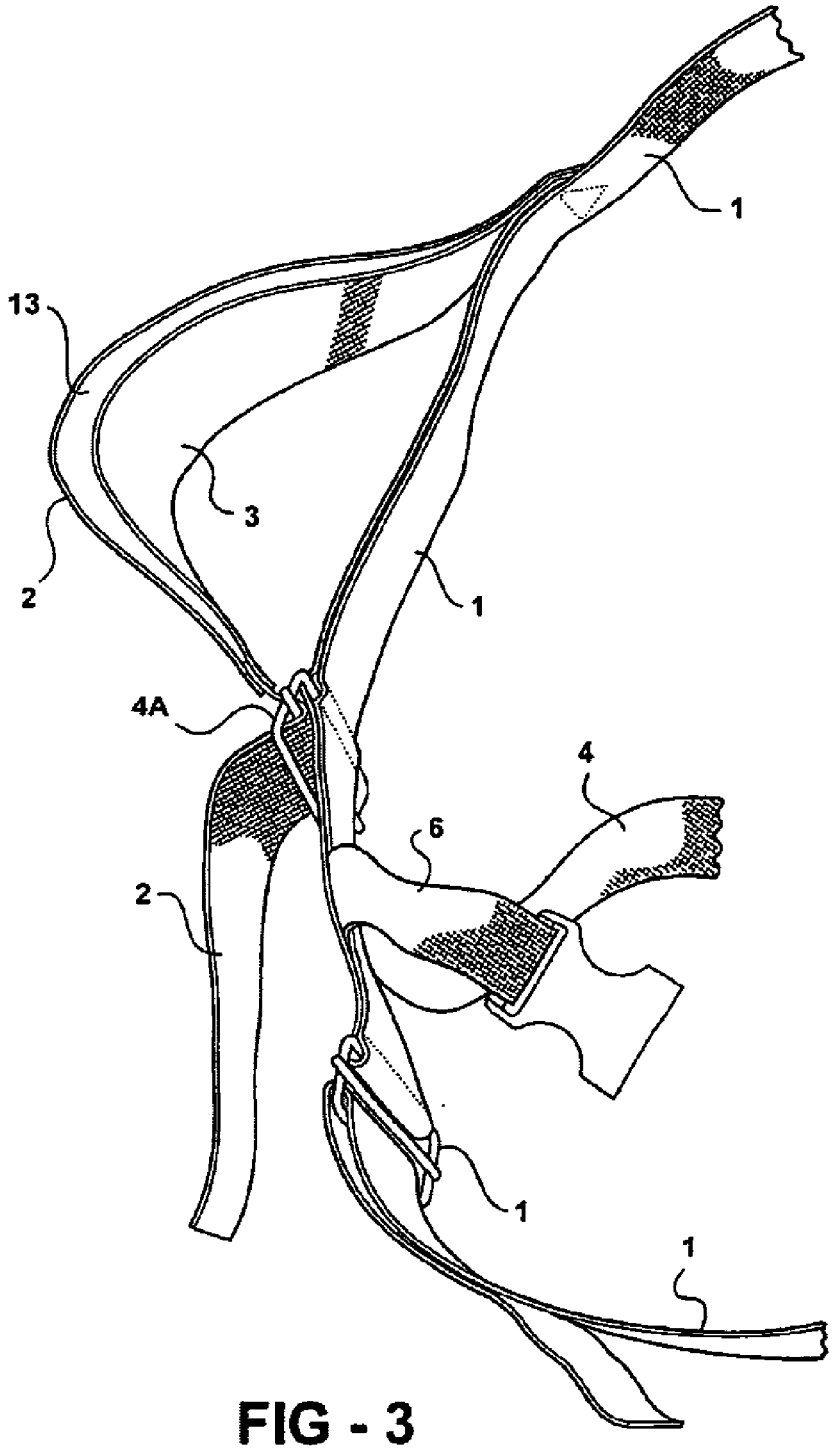
Figure 4:
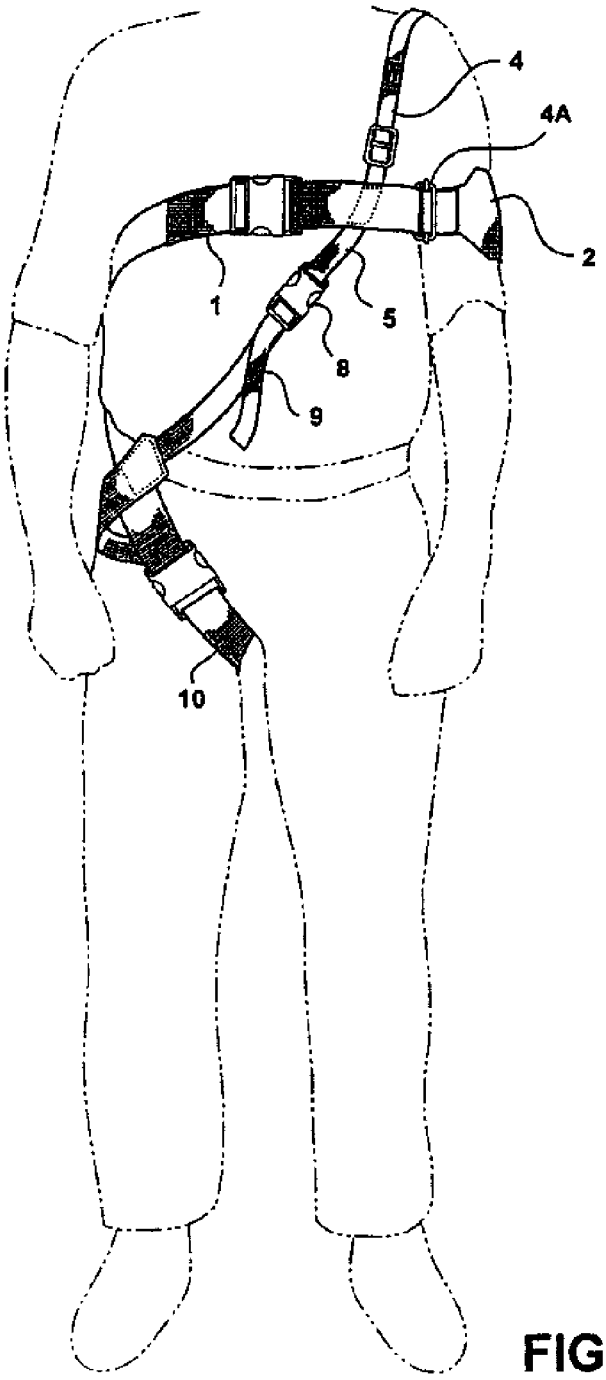
Figure 5:
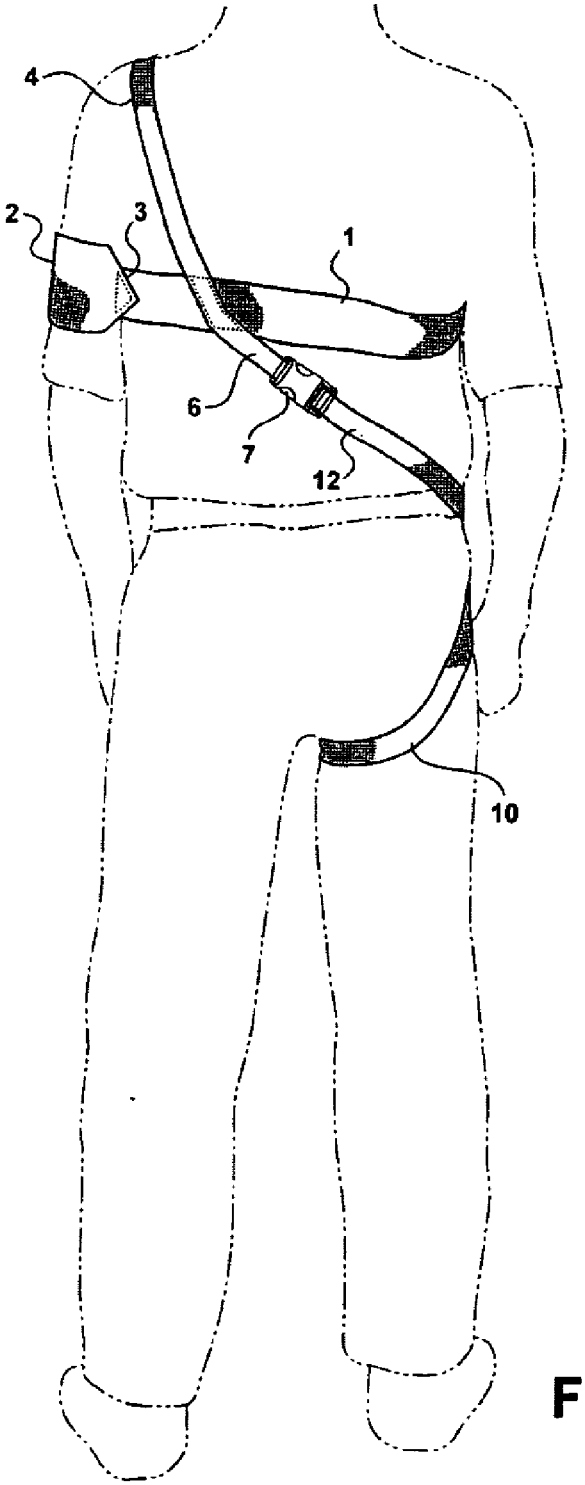
Figure 6:
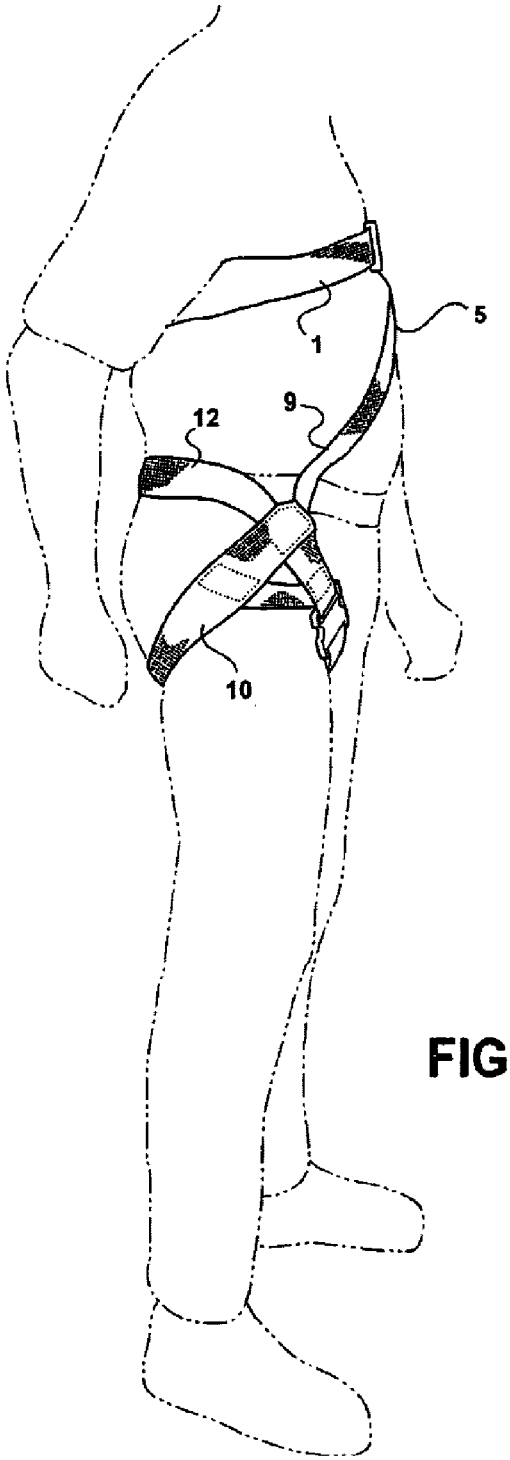

The reference numerals have the following meaning in said FIGS. 1 to 3:

1=The chest belt which preferably consists of a non-elastic belt strap. The circumferential length is approximately 1000 mm to 1500 mm, preferably 1100 mm and is length adjustable. The width of the chest belt is between 40 mm and 60 mm, preferably 50 mm, and its thickness is between 1 mm and 1.5 mm, preferably 1.2 mm.

The chest belt 1 can be opened by means of a buckle attached to the chest belt 1 and can be adjusted simultaneously in its circumference and its length, with the closure appropriately being made by means of a Velcro fastener, with the Velcro fastener being fixed to the outside of the chest belt 1, or with the chest belt 1 being provided with a snap buckle at position 1/1 for example (FIG. 1).

2=Outer arm strap, and

3=inner elastic arm strap jointly forming inner and outer sections of a double strap which is fixed on the one side to the chest belt 1 and can be closed on the other side by means of a Velcro fastener. The outer strap section 2 has a free surface and is suitable for outwardly applying a LOGO. The width of each inner and outer section is 80 to 120 mm each, preferably 100 mm, the thickness 0.8 mm to 1.2 mm, preferably 1.0 mm, and the length is 300 mm to 400 mm, preferably 350 mm. The inner strap section 3 is used preferably to cover any sewing work arising by the attachment of the LOGO on the inside of the outer strap section 2. When carrying the chest belt 1, the upper portion of the golf player's leading arm is situated between the outside of the strap section 3 and the chest belt 1, i.e. the strap sections 2 and 3 are situated close to each other and appear visually as a uniform band.

The double arm strap which consists of the outer section 2 and the inner section 3 can also consist of only a single strap section 2 or 3 in accordance with a variant of the invention.

A further embodiment of the invention provides an advantageously downwardly facing and fastened closure 13 (FIG. 1), e.g. a snap buckle, between the two strap sections 2 and 3 in order to fasten a leading arm rail with a joint (at the level of the arm joint).

4=A shoulder strap extends over the shoulder to support the chest belt at a level above the wearer's waist (of the trainee's leading arm). It is connected rigidly at both ends with the chest belt 1 and can be adjusted in its length and opened by means of a buckle closure.

The fixing of the shoulder strap to the chest belt 1 is situated at the one end directly close to the buckle (4A, FIG. 1) for adjusting the length of the arm strap sections 2 and 3, and at the other end approx. 200 mm away from the fixing of the arm strap sections 2 and 3 to the chest belt 1. The shoulder strap 4 is not elastic, has a length of 400 to 500 mm, preferably 450 mm, a width of 20 mm to 35 mm, preferably 25 mm, and a thickness of 0.8 to 1.5 mm, preferably 1.0 mm.

5=A fastening strap of a length of approximately 20 mm to 50 mm, preferably 30 mm, and a width of 20 to 35 mm, preferably 25 mm, and a thickness of 1.0 to 1.5 mm, preferably 1.2 mm, which is fastened at one end to the chest belt.1 at the fastening point of the shoulder strap 4 and includes a closure apparatus at the other end, preferably a snap buckle, with which the strap 5 can be connected via the closure apparatus 8 with the intermediate part 9.

6=A fastening strap of a length of approximately 20 mm to 50 mm, preferably 30 mm, and a width of 20 to 35 mm, preferably 25 mm, and a thickness of 1.0 to 1.5 mm, preferably 1.2 mm, which is fastened at one end to the chest belt 1 and includes a closure apparatus at the other end, preferably a snap buckle, with which the strap 6 can be directly connected with the loop 10 via the strap 11.

5/6=The angles of the strap 6 to the chest belt 1 and the strap 6 to the chest belt 1 can be mutually independent or preferably dependent and are 45° to 75°, in particular 60°.

7/8=Closure apparatuses, preferably snap buckles on the belt straps 5 and 6.

9=Non-elastic strap which is used as a connecting band from the strap 5 of the chest belt 1 to the strap 11 of the loop 10. The length without the closure connections is approx. 180 mm to 230 mm, preferably 200 mm, with a width of 22 mm to 30 mm, preferably 25 mm, and a thickness of 0.8 mm to 1.5 mm, preferably 1.2 mm. The two closures, preferably snap buckles, on the strap 9 are fixed to the respective ends of the strap.

10=A preferably non-elastic thigh strap forming a loop with a circumference of approximately 300 to 800 mm, preferably 600 mm, a width of 45 mm to 60 mm, preferably 50 mm, and a thickness of 1 mm to 1.5 mm, preferably 1.2 mm. This loop can additionally optionally be equipped with an elastic reinforcing band with a width of 80 mm to 130 m, preferably 100 mm, and a thickness of 0.8 mm to 1.5 mm, preferably 1.0 mm, which is fastened to the loop 10 at two opposite points approximately in the middle of loop 10, so that it rests horizontally on the thigh when being worn. It can be provided with a LOGO facing outwardly.

The loop can advantageously also be interrupted by and provided with a length-adjustable snap buckle at location 10/1 (FIG. 1) for example.

11=A non-elastic connecting strap which is fastened to one end of the loop 10 and is length-adjustable, having a length of approximately 220 mm to 270 mm, preferably 250 mm, a width of 22 mm to 30 mm, preferably 25 mm, and a thickness of 1 mm to 1.5 mm, preferably 1.2 mm, and which is provided at the other end with a closure apparatus, preferably a snap buckle, for joining with the connecting band 9.

12=A non-elastic connecting strap which is fastened to one end of the loop 10 and is length-adjustable, having a length of approximately 500 mm to 600 mm, preferably 550 mm, a width of 22 mm to 30 mm, preferably 25 mm, and a thickness of 1 mm to 1.5 mm, preferably 1.2 mm, and which is provided at the other end with a closure apparatus, preferably a snap buckle, which is used to directly join with the chest belt 1 at the closure point 7.

The two non-elastic connecting straps 11 and 12 are mutually fastened to the loop 10 at an angle of 75° to 110°, preferably 90°.

A preferred embodiment of the golf swing and hip rotation coordinator in accordance with the invention for a grown person is that said coordinator consists of the following:

a) a circumferentially adjustable non-elastic chest belt 1 with a width of 50 mm and a thickness of 1.2 mm which, when worn, encircles the back and the chest of a golf player, above the level of the player's waist; which belt is joined to a length-adjustable arm strap which encircles the upper portion of the leading arm of the golf player at the level of the chest belt and restrains independent movement of the arm. The arm strap of an outside elastic rubber strap 2 and an inner elastic strap 3, which each has a width of 100 mm, thickness of 1 mm and a length of 350 mm. The chest belt 1 further comprises a length-adjustable non-elastic strap 4 which has a length of 450 mm, a width of 25 mm and a thickness of 1 mm and which is fixed to the chest belt 1 and, when worn, overlies the shoulder of the leading arm of the golf player and maintains the chest belt at the desired level. To one end of the shoulder strap is attached a coupling strap 5 of 30 mm length and to whose other end a connecting strap 6 with a length of 30 mm, with each being fastened to the chest belt 1 at an angle each of approximately 60°, and on whose ends there is attached one snap buckle 7 and 8 each, with the end of the shoulder strap 4 and the joining place of the strap 5 with the snap buckle 8 being situated on the back when worn and the joining place of the connecting strap 6 with the snap buckle 7 being situated directly adjacent to the rubber arm straps 2 and 3 when worn, with the snap buckle 8 being connected via b) an intermediate connecting strap 9 with c) the strap 11 of the thigh loop 10 and the snap buckle 7 directly with the connecting strap 12 on the loop 10, with the strap 11 representing a length-adjustable connecting strap of 250 mm length, 25 mm width and 1.2 mm thickness, and the connecting strap 12 representing a length-adjustable connecting strap of 550 mm length, 25 mm width and 1.2 mm thickness, and with the two straps 11 and 12 being fastened to the thigh loop 10 at an angle of 90° with respect to each other.

The advantages of the golf swing and hip rotation coordinator in accordance with the invention over the known devices allow a precise control of the movements and position of the leading arm when striking the golf ball, namely both hip rotation as well as downward swing, as a result of the combination of chest belt 1 and thigh loop 10 via an intermediate connecting strap 9. This combination of a diagonally connected chest belt 1 and thigh loop 10 leads to a controlled sequence of the striking arm, with the upper arm portion of the leading arm being non-elastically connected to the chest, so that the elbow is not allowed to pivot outwardly during the strike. The leading arm is also better supported by the shoulder strap 4. The width of the chest belt 1 is kept narrow, leading to comfortable wearing (especially for ladies). The thigh loop combined with the chest belt 1 also leads to an increase in control of the swing sequence because the hip is automatically rotated rearwardly during the back swing and forwardly during the down swing. All this leads to a virtually automatic optimal golf swing and thus to an excellent stroke. The dream comes true for many practicing golf players to hit the golf ball optimally when learning to play golf.

The golf swing and hip rotation coordinator is worn over garments and is put on very quickly by pulling the chest belt 1 over the golf player's chest. Then the leading arm is positioned between the chest belt 1 and the arm strap consisting of the elastic straps 2 and 3 and finally the shoulder strap 4 is pulled over the shoulder of the leading arm. Secondly, the loop 10 is then pulled over the thigh diagonally remote from the leading arm and is connected via the connecting strap 9 directly with the chest belt 1. Thirdly, the entire combination of the golf swing and hip rotation coordinator is tightened and set by means of the attached buckle closures.

The golf swing and hip rotation coordinator in accordance with the invention is used as a training device especially in golf schools, golf academies, etc. as well as in private use at home or in the garden both for male and female golf players, and both left-hand and right-hand players.

The golf swing and hip rotation coordinator in accordance with the invention is both suitable for golf players using the right arm as the striking arm and the left arm as the leading arm as well as for such golf players who use the left arm as the striking arm and the right arm as the leading arm.

The new golf swing and hip rotation coordinator can be produced in any size, i.e. both in children's sizes for boys and girls as well as in adult sizes for men and women. It can be removed easily from the body, can be washed (hand washing), is light weight (approximately 300 to 400 grams) and is comfortable to wear.

The illustrations show the golf swing and hip rotation coordinator in accordance with the invention in closer detail.

What is claimed is:

1. Golf swing training apparatus for use by a golf trainee having a chest, a back, a waist, a leading arm and shoulder, and a trailing thigh, said apparatus comprising a chest belt for encircling the trainee's chest and back at a level above that of the trainee's waist; arm strap means for receiving an upper portion of the trainee's leading arm; a thigh strap forming a loop for encircling the trainee's trailing thigh at a level below that of the trainee's waist; means for securing said arm strap means to said chest belt at a level corresponding substantially to that of said chest belt and diagonally remote from said thigh strap; and connecting strap means securing said thigh strap to said chest belt adjacent said arm strap means, thereby enabling said connecting strap means to extend diagonally from said thigh strap toward said arm strap means.

2. Apparatus according to claim 1 wherein said chest belt, said thigh strap, and said connecting strap are inelastic.

3. Apparatus according to claim 1 wherein said arm strap means is elastic.

4. The apparatus according to claim 1 including a shoulder strap secured to said chest belt and being of such length as to extend over the trainee's leading arm shoulder.

5. The apparatus according to claim 1 wherein said connecting strap means includes means for adjusting its length.

6. The apparatus according to claim 1 wherein said thigh strap includes means for adjusting its length.

7. The apparatus according to claim 1 wherein said chest belt includes means for adjusting its length.

8. The apparatus according to claim 1 wherein said connecting strap means includes a first strap portion for overlying the trainee's back and a second strap portion for overlying the trainee's waist and chest.

9. The apparatus according to claim 1 wherein said thigh strap has opposite ends secured to one another.

10. The apparatus according to claim 9 including a reinforcing strap bridging the loop formed by said thigh strap adjacent the opposite ends thereof.

11. The apparatus according to claim 10 wherein said thigh strap is inelastic and said reinforcing strap is elastic.

12. A golf swing training apparatus for use by a golf trainee having a chest, a back, a leading arm and shoulder, a waist, and a trailing thigh diagonally remote from said leading arm, said apparatus comprising a chest belt of such length as to encircle the trainee's chest and back at a level below the trainee's shoulders and above the trainee's waist; arm strap means having opposite ends secured to said chest belt at a level corresponding substantially to that of said chest belt and in a position to be adjacent said leading arm; means carried by said arm strap means for receiving an upper portion of the trainee's leading arm; a thigh strap forming a loop of such size as to encircle the trailing thigh of the trainee; and connecting strap means securing said thigh strap to said chest belt, said connecting strap means having one section thereof diagonally spanning said loop and said chest belt in a position to overlie the trainee's back, said connecting strap means having another section diagonally spanning said loop and said chest belt in a position to overlie the trainee's waist and chest.

13. The apparatus according to claim 12 wherein said arm strap means includes separate sections together forming an opening for the accommodation of the trainee's leading arm upper portion.

14. The apparatus according to claim 13 wherein each of said separate sections is elastic.

15. The apparatus according to claim 12 including a shoulder strap of such length as to have its opposite ends secured to said chest belt and overlie the trainee's leading arm shoulder.

16. The apparatus according to claim 15 including means for adjusting the length of said shoulder strap.

17. The apparatus according to claim 12 wherein said chest belt, said arm strap means, said thigh strap, and said connecting strap means are inelastic.

18. The apparatus according to claim 12 including means for adjusting in length each of said chest belt, said arm strap means, said thigh strap, and said connecting strap means.

19. Golf swing apparatus for use by a trainee having a chest, a back, a leading arm and shoulder, a trailing thigh, and a waist, said apparatus comprising a chest belt for encircling the trainee's chest and back at a level above that of the trainee's waist; an arm strap secured to the chest belt at a position which when worn by the trainee will be adjacent the trainee's leading arm, said arm strap including means for encircling an upper portion of the trainee's leading arm; a thigh strap forming a loop for encircling the trainee's trailing thigh; connecting strap means extending from said thigh strap to said chest belt, said connecting strap means including a first section and a second section each of which extends from said thigh strap to said chest strap, said first section extending diagonally from said thigh strap to said chest belt and across the trainee's back when worn and said second section extending diagonally from said thigh strap to said chest belt and across the trainee's waist and chest when worn; and a shoulder strap secured to said chest belt in a position to overlie the trainee's leading arm shoulder when worn and maintain said chest belt at said level.

* * * * *

UNITED STATES PATENT AND TRADEMARK OFFICE

CERTIFICATE OF CORRECTION

PATENT NO. : 6,832,960 B2
DATED : December 21, 2004
INVENTOR(S) : Franz Thony

It is certified that error appears in the above-identified patent and that said Letters Patent is hereby corrected as shown below:

Please replace the title page with the attached title page.

Please replace the old drawings with the new drawings attached.

Signed and Sealed this

Twelfth Day of April, 2005

JON W. DUDAS
*Director of the United States Patent and Trademark Office*

(12) United States Patent
Thöny

(10) Patent No.: US 6,832,960 B2
(45) Date of Patent: Dec. 21, 2004

(54) GOLF SWING AND HIP ROTATION CONNECTOR

(75) Inventor: Franz Thöny, Eschen (LI)

(73) Assignee: VIB Line Establishment, Schaan (LI)

( * ) Notice: Subject to any disclaimer, the term of this patent is extended or adjusted under 35 U.S.C. 154(b) by 0 days.

(21) Appl. No.: 10/668,420

(22) Filed: Sep. 23, 2003

(65) Prior Publication Data

US 2004/0063513 A1 Apr. 1, 2004

(30) Foreign Application Priority Data

Sep. 27, 2002 (CH) ..... 1625/02

(51) Int. Cl.[7] ..... A63B 69/36
(52) U.S. Cl. ..... 473/277; 473/207
(58) Field of Search ..... 473/212, 215, 473/266, 276, 277, 422

(56) References Cited

U.S. PATENT DOCUMENTS

| | | | | | |
|---|---|---|---|---|---|
| 475,432 | A | * | 5/1892 | Blades | 473/415 |
| 1,618,273 | A | * | 2/1927 | Davidson | 482/124 |
| 2,980,426 | A | * | 4/1961 | Johnson | 473/63 |
| 3,101,196 | A | * | 8/1963 | Ferrara | 473/63 |
| 3,970,316 | A | | 7/1976 | Westmoreland, Jr. | |
| 4,691,924 | A | | 9/1987 | Strong | |
| 4,892,317 | A | * | 1/1990 | Corder, Jr. | 473/212 |
| 5,188,365 | A | * | 2/1993 | Picard | 473/213 |
| 5,203,754 | A | * | 4/1993 | Maclean | 482/124 |
| 5,518,480 | A | * | 5/1996 | Frappier | 482/124 |
| 5,665,015 | A | * | 9/1997 | Clark, III | 473/409 |
| 6,126,554 | A | * | 10/2000 | Poscente | 473/212 |
| 6,129,638 | A | * | 10/2000 | Davis | 473/215 |

* cited by examiner

*Primary Examiner*—Nini F. Legesse
(74) *Attorney, Agent, or Firm*—John K. McCulloch

(57) ABSTRACT

A chest belt for encircling the back and chest of a trainee at a level above the waist, an arm strap for accommodating the upper arm portion of the trainee's leading arm, a shoulder strap for overlying the shoulder of the leading arm, a thigh strap forming a loop for encircling that thigh of the trainee opposite the leading arm, and connecting straps coupling the thigh straps to the chest strap and extending diagonally across the front and back of the trainee. The construction is such that the trainee's shoulders and hips partake of coordinated movements during the execution of a golf swing.

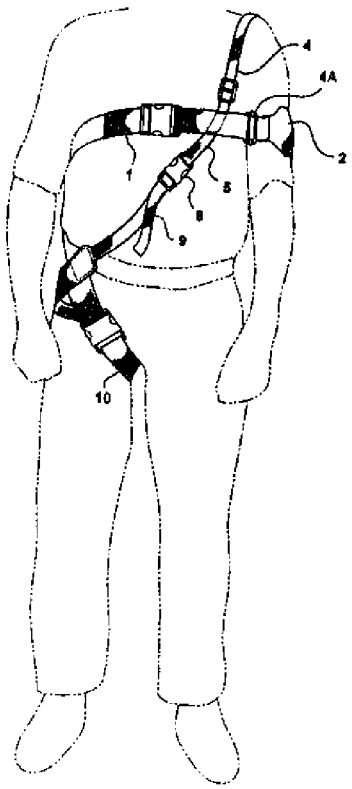

19 Claims, 6 Drawing Sheets